US009691514B2

(12) United States Patent
Snader, Jr.

(10) Patent No.: US 9,691,514 B2
(45) Date of Patent: Jun. 27, 2017

(54) ELECTRICAL ASSEMBLY HAVING A FIBROUS CONDUCTIVE INTERFACE BETWEEN A CONDUCTIVE COMPOSITE COMPONENT AND A METALLIC COMPONENT

(71) Applicant: DELPHI TECHNOLOGIES, INC., Troy, MI (US)

(72) Inventor: Robert B. Snader, Jr., Solon, OH (US)

(73) Assignee: DELPHI TECHNOLOGIES, INC., Troy, MI (US)

( * ) Notice: Subject to any disclaimer, the term of this patent is extended or adjusted under 35 U.S.C. 154(b) by 72 days.

(21) Appl. No.: 14/602,402

(22) Filed: Jan. 22, 2015

(65) Prior Publication Data

US 2016/0218466 A1 Jul. 28, 2016

(51) Int. Cl.

| | |
|---|---|
| ***H01B 1/22*** | (2006.01) |
| ***H01R 13/6599*** | (2011.01) |
| ***H01B 1/02*** | (2006.01) |
| *H01R 43/00* | (2006.01) |
| *H01R 12/77* | (2011.01) |

(52) U.S. Cl.

CPC ..... *H01B 1/02* (2013.01); *H01B 1/22* (2013.01); *H01R 13/6599* (2013.01); *H01R 12/775* (2013.01); *H01R 43/007* (2013.01)

(58) Field of Classification Search

CPC ..... H01R 13/2414; H01R 13/6584; H01R 13/405; H01R 43/007; H01R 13/6599; H01R 9/11; H05K 9/009; H01B 1/22; H01B 1/24; H01B 1/02

USPC ..... 439/607.02, 607.03, 607.15, 607.34, 439/607.41, 607.45, 607.58, 931, 86–89, 439/607.27, 607.28, 874–876, 90–91, 439/586, 385; 29/841; 264/449; 174/74 R

See application file for complete search history.

(56) References Cited

U.S. PATENT DOCUMENTS

| | | | | |
|---|---|---|---|---|
| 3,322,885 A * | 5/1967 | May | H01R 4/58 | 174/76 |
| 4,822,950 A * | 4/1989 | Schmitt | H01B 11/1813 | 174/109 |
| 5,006,286 A * | 4/1991 | Dery | H01R 4/04 | 174/76 |
| 5,281,762 A * | 1/1994 | Long | H01R 9/0515 | 174/117 F |

(Continued)

*Primary Examiner* — Gary Paumen
*Assistant Examiner* — Paul Baillargeon
(74) *Attorney, Agent, or Firm* — Robert J. Myers

(57) ABSTRACT

An electrical assembly including a first element, such as a connector body, formed of a conductive composite material and a second element formed of a solid metallic material, such as a sheet metal electromagnetic interference shield, defining a fibrous conductive region formed of a plurality of metallic filaments. The conductive composite material forming the first element completely surrounds a portion of the fibrous conductive region. Conductive fibers in the conductive composite material are in intimate contact with the fibrous conductive region, forming a very high number of electrical contact points between the conductive fibers in the conductive composite material and the fibrous conductive region and thereby providing a robust electrical connection between the first element and the second element.

12 Claims, 2 Drawing Sheets

(56) References Cited

U.S. PATENT DOCUMENTS

| | | | | | |
|---|---|---|---|---|---|
| 5,364,292 | A * | 11/1994 | Bethurum | H01R 13/6599 | 439/607.02 |
| 5,739,471 | A * | 4/1998 | Burisch | H01B 11/105 | 174/102 R |
| 6,575,772 | B1 * | 6/2003 | Soubh | G01R 1/18 | 439/581 |
| 6,709,294 | B1 * | 3/2004 | Cohen | H01R 13/6599 | 333/184 |
| 2002/0142676 | A1 * | 10/2002 | Hosaka | H01R 13/405 | 439/874 |
| 2005/0224280 | A1 * | 10/2005 | Aisenbrey | B29C 45/0013 | 181/148 |
| 2015/0038025 | A1 * | 2/2015 | Mueller | H01R 4/184 | 439/874 |
| 2015/0357078 | A1 * | 12/2015 | Lessing | B29C 39/18 | 73/774 |

* cited by examiner

ELECTRICAL ASSEMBLY HAVING A FIBROUS CONDUCTIVE INTERFACE BETWEEN A CONDUCTIVE COMPOSITE COMPONENT AND A METALLIC COMPONENT

TECHNICAL FIELD OF THE INVENTION

The invention relates to an electrical assembly such as an electrical connector, particularly an electrical assembly having a fibrous conductive interface between a conductive composite component and a metallic component.

BACKGROUND OF THE INVENTION

Current technology in high voltage connection systems is beginning to utilize conductive polymers in the connector housing designs, particular for use as an electromagnetic interference (EMI) shielding material as a cost saving alternative to formed metal shield cans. This application of conductive polymers as an EMI shielding material has been limited however because of the challenge of making reliable electrical contact between the conductive plastic and solid metal componentry in the assemblies such as drain/ground interfaces. The interface between conductive plastic and solid metal components is currently made using, knurled bushings that are insert molded into the conductive plastic components and secured to the solid metal components by punched rivets. This type of interface has been found to work in limited applications having very simple geometry of the conductive plastic components. However plastic warping and thermal shock due to differences in the coefficients of thermal expansion between the metal and plastic components may cause the plastic to break surface contact with the metal components. This severely degrades the electrical contact performance of the interface.

The subject matter discussed in the background section should not be assumed to be prior art merely as a result of its mention in the background section. Similarly, a problem mentioned in the background section or associated with the subject matter of the background section should not be assumed to have been previously recognized in the prior art. The subject matter in the background section merely represents different approaches, which in and of themselves may also be inventions.

BRIEF SUMMARY OF THE INVENTION

In accordance with an embodiment of the invention, an electrical assembly is provided. The electrical assembly includes a first element that is formed of a conductive composite material and a second element formed of a solid metallic material defining a fibrous conductive region. The conductive composite material forming the first element completely surrounds a portion of the fibrous conductive region. The conductive composite material forming the first element may completely enclose and surround the fibrous conductive region. The conductive composite material forming the first element may partially enclose a portion of the second element.

The fibrous conductive region may comprise a plurality of metallic filaments each having a fixed end mechanically and electrically bonded to the second element and each having a free end extending from the second element into the first element. The free ends of the plurality of metallic filaments may be flared so that a spacing of each fixed end one to another is less than a spacing of each free end one to another.

Each filament in the plurality of metallic filaments may be substantially parallel to every other filament, i.e. the filaments do not intersect along their length and are not in direct mechanical contact with each other except possibly at the fixed end. Alternatively, the plurality of metallic filaments may form a metallic mesh having at least a portion of the filaments in mechanical and electrical contact with other filaments in the plurality of metallic filaments.

The fixed ends of the plurality of metallic filaments may be sonically welded to the second element. The conductive composite material may contain a plurality of conductive fibers.

In accordance with another embodiment an electrical connector assembly is provided. In this embodiment, the first element is a connector body formed of a conductive composite material and the second element is an electromagnetic interference shield formed of a solid metallic material.

BRIEF DESCRIPTION OF THE SEVERAL VIEWS OF THE DRAWING

The present invention will now be described, by way of example with reference to the accompanying drawings, in which.

DETAILED DESCRIPTION OF THE INVENTION

Figure 1:
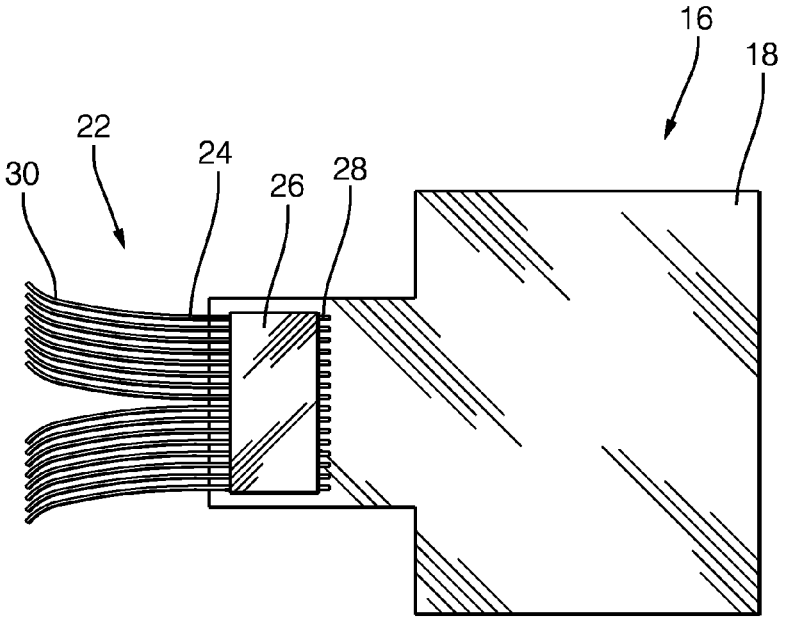
FIG. 1 is a schematic top view of a solid metallic component having a fibrous conductive region according to one embodiment.

Described herein is an electrical assembly 10, e.g. an electrical connector assembly 10, that has an interface between a first element 12 that is formed of a conductive composite material 14, e.g. an electrical connector body 12, and a second element 16 formed of a solid metallic material 18, e.g. a sheet metal shield 16 that provides electromagnetic interference (EMI) shielding. The conductive composite material 14 may include conductive fibers 20 made of nickel plated carbon or stainless steel in a polymer matrix such as polyamide (PA), acrylonitrile butadiene styrene (ABS), or polycarbonate (PC). Such conductive composite materials are available from ElectriPlast Corporation of Fort Washington, Pa.

According to the non-limiting example shown in FIG. 1, an electrical connector assembly 10 includes a sheet metal EMI shield 16 having a flexible fibrous conductive region 22 that provides chaotically oriented geometry. In the illustrated example of FIG. 1, the fibrous conductive region 22 comprises a plurality of thin metallic filaments 24 that is made up of lengths of finely stranded, copper wires. The thickness of the filaments 24 should be comparable to the thickness of the conductive fibers 20 in the conductive composite material 14, e.g. about one to three times the thickness of the conductive fibers 20. The filaments 24 may be attached by a weld 26 to the EMI shield 16 at their fixed ends 28 and flared at their free ends 30 so that the spacing between the free ends 30 of the filaments 24 is greater than the spacing between the fixed ends 28 of the filaments 24. The filaments 24 may be welded 24 to the EMI shield 16 using a sonic welding process, soldering process, or any other process of joining conductive filaments to a solid metal object known to those skilled in the art.

Figure 2:
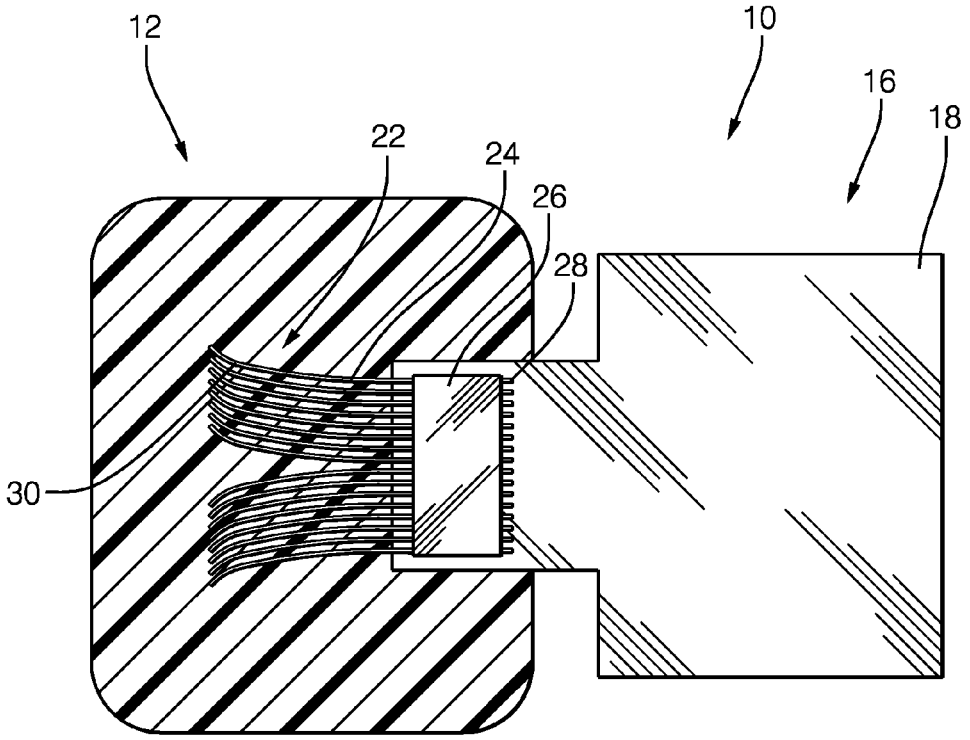
FIG. 2 is cross section view of a conductive composite component surrounding the solid metallic component of FIG. 1 according to one embodiment.

As illustrated in FIG. 2, the conductive composite material 14 forming the connector body 12 surrounds and encloses the plurality of filaments 24. The connector body 12 may be formed by placing the portion of the EMI shield 16 to which the filaments 24 are attached into a mold (not shown) and injecting the conductive composite material 14 into the mold so that the conductive composite material 14 surrounds and encloses the plurality of filaments 24.

Figure 3:
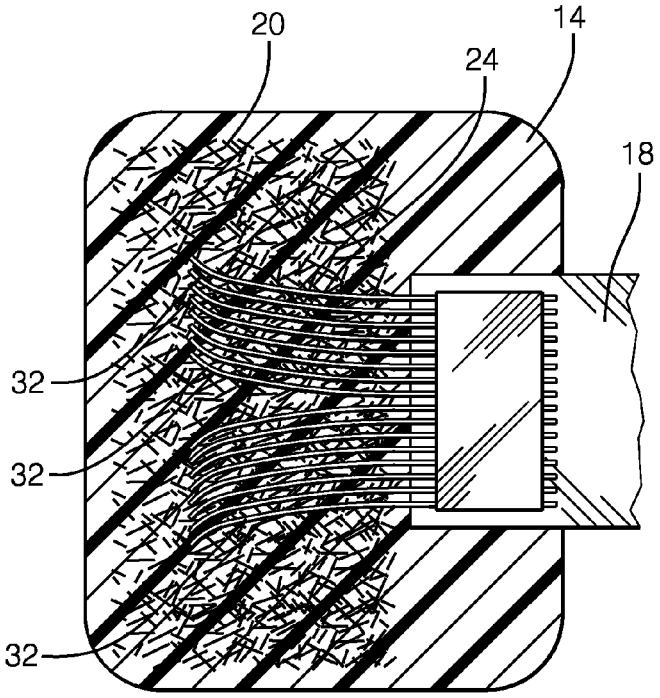
FIG. 3 is partial close up cross section view of the conductive fibers of the conductive composite component of FIG. 2 according to one embodiment.

Without subscribing to any particular theory of operation, as the conductive composite material 14 is injected into the mold, the conductive fibers 20 become in intimate contact with the filaments 24 by becoming entangled within the plurality of filaments 24, forming a very high number of electrical contact points 32 between the conducive fibers in the conductive composite material 14 and the plurality of filaments 24 and thereby providing a robust electrical connection between the conductive composite material 14 and the EMI shield 16 to which the filaments 24 are connected as illustrated in FIG. 3. As the conductive composite material 14 is injected into the mold, it is forced to flow quite randomly through the filaments 24, ensuring the conductive fibers 20 in the conductive composite material 14 chaotically orient themselves in that region, which is desirable for the electrical performance of the conductive composite material 14. In addition, the thin flexible filaments 24 are able to bend and maintain contact with the conductive fibers 20 when the conductive composite is flexed and as it undergoes thermal expansion and contraction.

Figure 4:
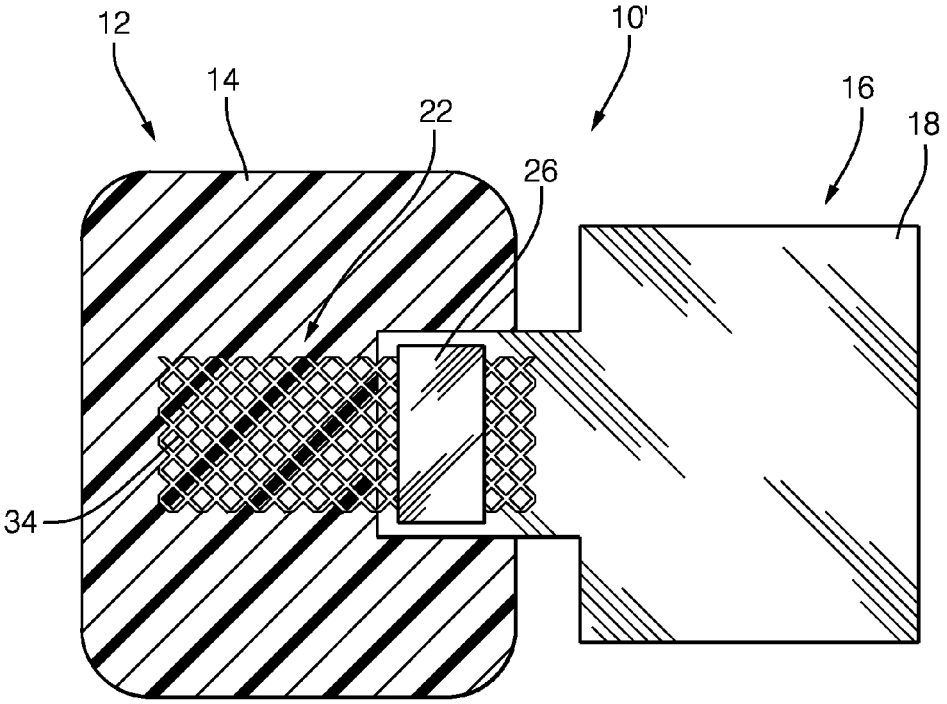
FIG. 4 is cross section view of a conductive composite component surrounding a solid metallic component having a fibrous conductive region according to another embodiment.

FIG. 4 illustrates an alternative embodiment of the electrical assembly 10' wherein the fibrous conductive region 22 comprises a conductive mesh 34 rather than a plurality of substantially parallel filaments. The conductive mesh 34 may be a woven metallic wire mesh, such as that used for shielding wire cables, or it could be an amorphous mesh, such as steel or copper wool. The mesh 34 may be attached by a weld 26 to the EMI shield 16 using a sonic welding process, soldering process, or any other process of joining a conductive mesh to a solid metal object known to those skilled in the art.

While the illustrated examples show and electrical connector assembly 10 having a sheet metal EMI shield 16 and a connector body 12 formed of conductive composite material 14, other embodiments may be envisioned including an electrical assembly 10 having a solid metallic component 16 and a conductive composite component 12 of any other configuration interfaced by a fibrous conductive region 22.

Accordingly an electrical assembly 10 having an interface between a conductive composite component 12 and a solid metallic component 16 is provided. Rather than depending on a solid portion of metal, e.g. a knurled bushing, to interface with the conductive fibers in the conductive composite material, either by line-line surface contact or inherent normal force by press fitting operations as done prior, the fibrous conductive region 22 of the electrical assembly 10 provides a flexible interface between the conductive composite component 12 and the solid metallic component 16. The fibrous conductive region 22 can maintain electrical contact between the solid metallic component 16 and the conductive fibers 20 of the conductive composite component 12 under the effects of mechanical and/or thermal expansion and contraction. The fibrous conductive region 22 also substantially increases the number of electrical contact points 32 to a level that even if only 25% of the contacts points remained intact after severe flexing, expanding, or contracting, this electrical interface would still be superior to previous connection schemes. The fibrous conductive region 22 may be incorporated into existing electrical assemblies having conductive composite components interfacing with solid metallic components, thereby eliminating the need to build tools for or purchase new parts.

While this invention has been described in terms of the preferred embodiments thereof, it is not intended to be so limited, but rather only to the extent set forth in the claims that follow. Moreover, the use of the terms first, second, etc. does not denote any order of importance, but rather the terms first, second, etc. are used to distinguish one element from another. Furthermore, the use of the terms a, an, etc. do not denote a limitation of quantity, but rather denote the presence of at least one of the referenced items.

I claim:

1. An electrical assembly, comprising:

a first element formed of a conductive composite material containing a plurality of conductive fibers;

a second element formed of sheet metal; and a plurality of metallic filaments, each metallic filament in the plurality of metallic filaments separately having an attached end mechanically and electrically bonded to the second element and each metallic filament in the plurality of metallic filaments separately having an unattached end extending from the second element into the first element, wherein the conductive composite material forming the first element completely surrounds and completely encloses the unattached end of each metallic filament.

2. The electrical assembly, according to claim 1, wherein the conductive composite material forming the first element partially encloses a portion of the second element.

3. The electrical assembly, according to claim 1, wherein a spacing of the attached end one to another is less than a spacing of the unattached end one to another.

4. The electrical assembly, according to claim 1, wherein one metallic filament in the plurality of metallic filaments is substantially parallel to another metallic filament.

5. The electrical assembly, according to claim 1, wherein the attached ends of the plurality of metallic filaments are sonically welded to the second element.

6. The electrical assembly, according to claim 1, wherein a thickness of each of the plurality of metallic filaments is in a range of one to three times a thickness of a conductive fiber in the plurality of conductive fibers.

7. An electrical connector assembly, comprising:

a connector body formed of a conductive composite material containing a plurality of conductive fibers;

an electromagnetic interference (EMI) shield formed of sheet metal; and a plurality of metallic filaments, each metallic filament in the plurality of metallic filaments having an attached end mechanically and electrically bonded to the EMI shield and each metallic filament in the plurality of metallic filaments separately having an unattached end extending from the EMI shield into the connector body, wherein the conductive composite material forming the connector body completely surrounds and completely encloses the unattached end of each metallic filament.

8. The electrical connector assembly, according to claim 7, wherein the conductive composite material forming the connector body partially encloses a portion of the EMI shield.

9. The electrical connector assembly, according to claim 7, wherein a spacing of each attached end one to another is less than a spacing of each unattached end one to another.

10. The electrical connector assembly, according to claim 7, wherein one metallic filament in the plurality of metallic filaments is substantially parallel to another metallic filament.

11. The electrical connector assembly, according to claim 7, wherein the attached ends of the plurality of metallic filaments is sonically welded to the EMI shield.

12. The electrical connector assembly, according to claim 7, wherein a thickness of each of the plurality of metallic filaments is in a range of one to three times a thickness of a conductive fiber in the plurality of conductive fibers.

* * * * *